US012209399B2

(12) United States Patent
Bordin

(10) Patent No.: US 12,209,399 B2
(45) Date of Patent: Jan. 28, 2025

(54) SHOWER DRAIN ASSEMBLY AND KIT FOR ITS INSTALLATION

(71) Applicant: PROGRESS PROFILES SPA, Asolo (IT)

(72) Inventor: Dennis Bordin, Asolo (IT)

(73) Assignee: PROGRESS PROFILES SPA, Asolo (IT)

( * ) Notice: Subject to any disclaimer, the term of this patent is extended or adjusted under 35 U.S.C. 154(b) by 21 days.

(21) Appl. No.: 18/087,888

(22) Filed: Dec. 23, 2022

(65) Prior Publication Data

US 2023/0203798 A1 Jun. 29, 2023

(30) Foreign Application Priority Data

Dec. 24, 2021 (IT) ..... 102021000032609

(51) Int. Cl.
*E03C 1/22* (2006.01)

(52) U.S. Cl.
CPC ..... *E03C 1/22* (2013.01)

(58) Field of Classification Search
CPC ..... E03C 1/22
See application file for complete search history.

(56) References Cited

U.S. PATENT DOCUMENTS

| | | | | |
|---|---|---|---|---|
| 8,001,629 | B2 | 8/2011 | Lang et al. | |
| 8,474,068 | B2 * | 7/2013 | Kik, Sr. | E03F 5/0408 4/679 |
| 10,550,563 | B1 * | 2/2020 | Kozlowski | E03C 1/22 |
| 2020/0157790 | A1 * | 5/2020 | English | E03C 1/264 |

FOREIGN PATENT DOCUMENTS

| | | | | |
|---|---|---|---|---|
| DE | 202009003121 | U1 * | 6/2010 | A47K 3/40 |
| EP | 2664722 | B1 | 5/2017 | |
| ES | 2344369 | | 12/2008 | |
| PT | 1782721 | E | 10/2015 | |
| WO | 2021245479 | A1 | 12/2021 | |

OTHER PUBLICATIONS

IT Search Report and Written Opinion; IT Application No. 202100032609; Date of Search Jul. 22, 2022; 10 pages.
European Search Report for European Application 22213948.7, dated May 8, 2023, 9 pages.
European Office Action for Application No. 22213948.7, dated Nov. 26, 2024, 9 pages.

* cited by examiner

*Primary Examiner* — Christine J Skubinna
(74) *Attorney, Agent, or Firm* — CANTOR COLBURN LLP

(57) ABSTRACT

A shower drain assembly including a trough with a tray element with its bottom provided with a drain hole, a covering element for the trough; and elements for association between a structure of the trough and the covering element, which are adapted to define various possible distances of the covering element from the bottom.

8 Claims, 8 Drawing Sheets

SHOWER DRAIN ASSEMBLY AND KIT FOR ITS INSTALLATION

CROSS-REFERENCE TO RELATED APPLICATIONS

This application is related to and claims the benefit of Italian Patent Application No. 102021000032609, filed on Dec. 24, 2021, the contents of which are herein incorporated by reference in their entirety.

TECHNICAL FIELD

The present disclosure relates to a shower drain assembly and a kit for its installation.

The disclosure can be applied in shower cubicles in bathrooms, in the area of the shower pan where the water is conveyed down adapted slopes in order to be drained into a pipe connected to the plumbing system.

BACKGROUND

In recent years the trend has become widespread of making shower pans with the same coverings as the floors of bathrooms, and in order to do this it is necessary for each implementation to make use of a special fixture, sometimes organized in a kit, which comprises at least waterproofing panels on which to lay the coverings, a drain assembly with a trough for collecting the water, which has an upper covering element that can be removed in order to facilitate the cleaning and inspection of a trap located below, a waterproofing membrane to be laid around the perimeter of the trough, and profiles for completing the perimeter of the shower pans.

The trough for collecting water has a drain hole, underneath which the trap is located, and it has an inward slope to make the water flow toward the drain.

The covering element has feet which protrude downward with respect to the position for use, with which it rests on the bottom of the trough and by virtue of which it reaches the desired height.

In fact, the covering of the shower pan is often done with the same tiles as the flooring of the bathroom, in continuity therewith, and the covering element of the drain assembly is positioned flush with the floor (or shower pan), therefore at the same height as the tiles. The latter has a main body made of metallic material and has a flat surface, which can be smooth or have openings that can be made in various different shapes and sizes. Sometimes the covering element is also covered with tiles. The fixture needs to have a covering element of suitable height, as a function of the thickness of the tiles, so that in any version thereof it will be flush with the floor.

In the embodiments described above, the trough can be installed on the shower pan or vertically in the wall, with the opening toward the shower in order to collect the water with a suitable slope in said shower pan. Another drawback is therefore encountered in the fact that the trough for installation in the shower pan cannot be used for installation in a wall, where the same trough needs to have such a shape as to define a recess to be set into a wall, and the covering element needs to be positioned vertically, to cover the opening that faces toward the shower.

SUMMARY

The present disclosure provides a shower drain assembly that is capable of improving the known art in one or more of the above mentioned aspects.

Within this aim, the disclosure provides a drain assembly with a covering element, which can be used in installations with different thicknesses of tiles in order to ensure a final height that is flush with the floor.

The disclosure further provides a drain assembly that can be installed both in shower drainage systems that are flush with the floor, with a horizontal covering element, and in shower drainage systems that are wall-mounted, with a vertical covering element and flush with the wall.

The present disclosure also overcomes the drawbacks of the background art in a manner that is alternative to any existing solutions.

The disclosure provides a drain assembly that is highly reliable, easy to implement and low-cost.

This aim and these and other advantages which will become more apparent hereinafter are achieved by providing a shower drain assembly, which comprises:

- a trough with a tray element with its bottom provided with a drain hole,
- a covering element for said trough,
- said drain assembly being characterized in that it comprises means for association between the structure of said trough and said covering element which are adapted to define various possible distances of the latter from the bottom.

The disclosure also relates to a kit for installing a shower drain assembly, which comprises:

- a trough with a drain hole,
- a covering element for said trough,
- a waterproofing membrane,
- a template that can be inserted in the opening of said trough in order to lay tiles around it,
- at least one set of elements to be coupled to said covering element so as to protrude therefrom, by an amount that is a function of the set, on the side that is not visible with respect to its installation position.

BRIEF DESCRIPTION OF THE DRAWINGS

Further characteristics and advantages of the disclosure will become more apparent from the detailed description that follows of a preferred, but not exclusive, embodiment of the drain assembly according to the disclosure, which is illustrated by way of non-limiting example in the accompanying drawings wherein:

FIG. 8 is a plan view from above of the trough of the drain assembly shown in

FIG. 7;

DETAILED DESCRIPTION OF THE DRAWINGS

Figure 1:
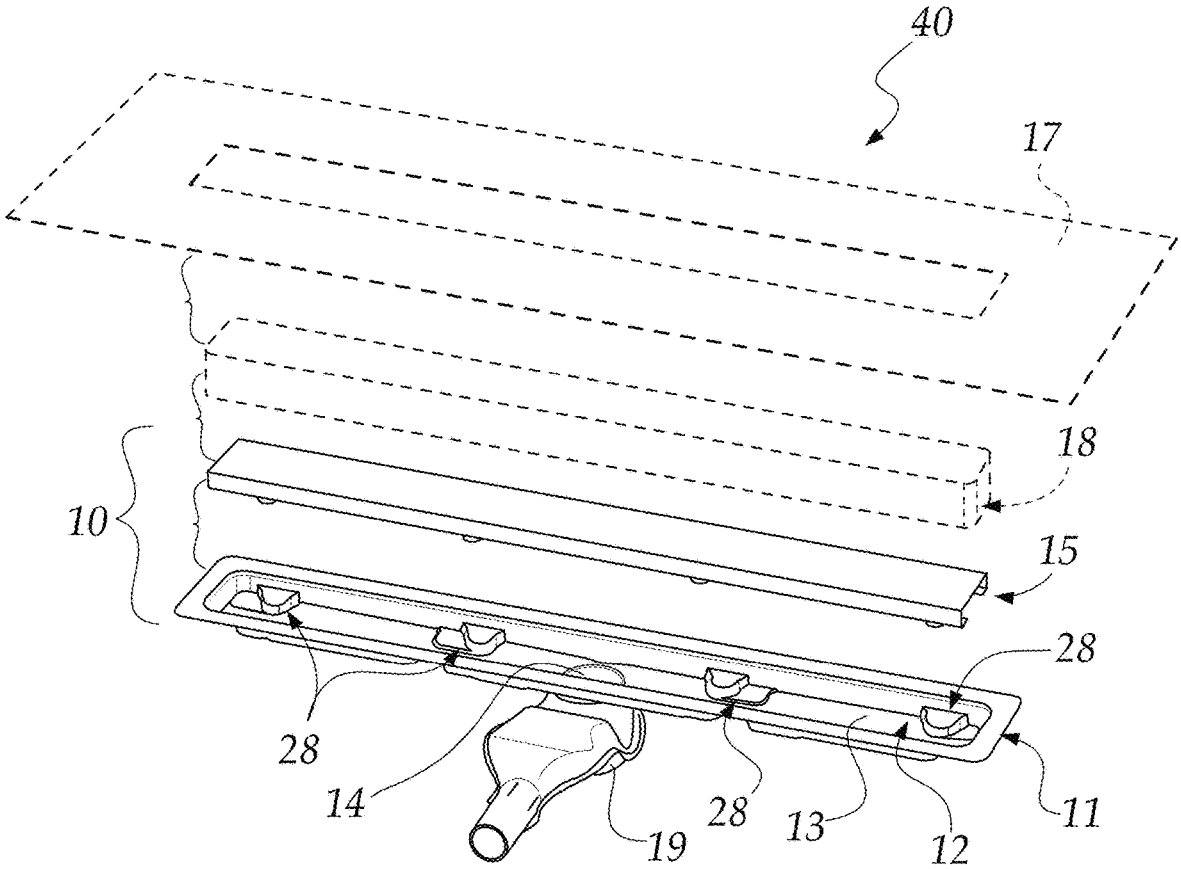
FIG. 1 is an exploded perspective view of a drain assembly and a kit according to the disclosure, for installation in a floor.
Figure 2:
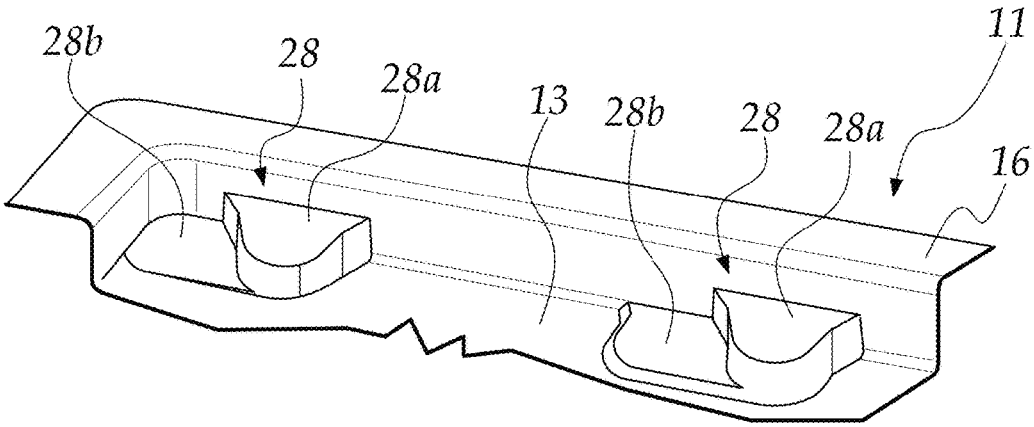
FIG. 2 shows a portion of the trough.

With reference to the figures, the drain assembly according to the disclosure, generally designated by the reference numeral 10, comprises:

- a trough 11 with a tray element 12 with its bottom 13 provided with a drain hole 14 and a downward slope in the direction of the drain hole 14,
- a covering element 15 for the trough 11, which is adapted to conceal at least partially the opening thereof.

The trough 11 is conveniently provided with a flat, frame-like perimetric rim 16 on which a waterproofing membrane can be applied which is conventional per se, like the one in dotted lines indicated with 17 in FIG. 1, in order to seal the joint between the trough 11 and a waterproofing system, which can be constituted for example by a tileable panel, also conventional per se. FIG. 1 shows the drain assembly 10 in use in a floor.

Figure 6:
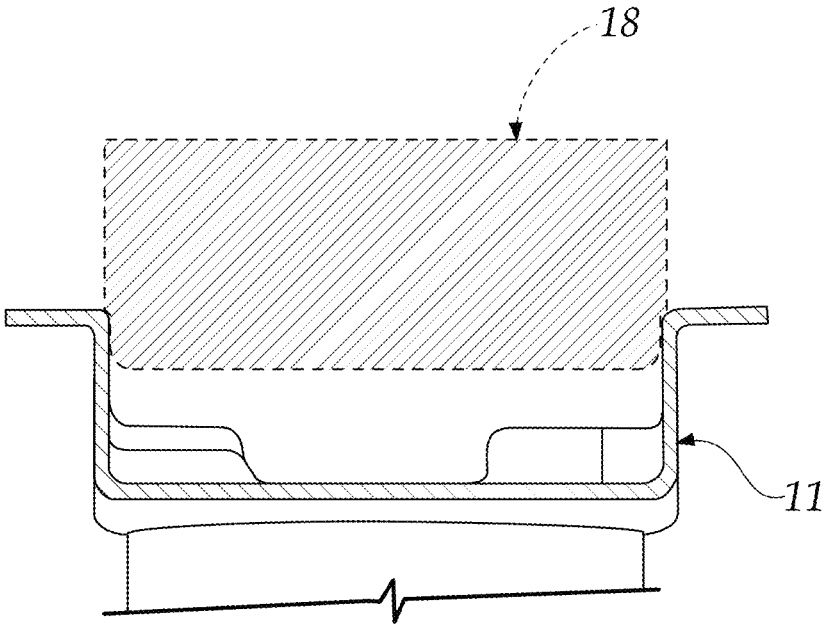
FIG. 6 is a cross-sectional view of the trough with a template for laying tiles.

FIG. 1 also shows, in dotted lines, a template 18, preferably made of low-density polystyrene, with a parallelepiped body not much wider than the opening of the trough 11 (wider by a few millimeters) and to be pushed partially into it, as shown in the cross-section of FIG. 6. Such template 18 is used during the step of laying the tiles and enables a correct laying thereof, because by bringing them into abutment against the upper part of the template 18 it is possible to obtain, after laying is complete, a slit between the perimeter of the trough 11 and the covering element 15, which during use of the shower pan ensures the outflow of water.

The covering element 15 can also be tiled or it can be smooth or perforated, with openings of various possible shapes and dimensions.

The trough 11 is conveniently provided with a trap 19, preferably made of polypropylene, with a drain of, for example, 32 mm in diameter in order to ensure an outflow of approximately 34 l/min.

Above the drain hole 14 there can be a hair catcher mesh. The drain assembly 10 advantageously comprises means 20 for association between the structure of the trough 11 and the covering element 15, which are adapted to define various possible distances of the latter from the bottom 13.

In particular, such means 20 for association comprise at least one set of elements 21 to be coupled to the covering element 15 so as to protrude therefrom on the side that is not visible with respect to its installation position.

Figure 5:
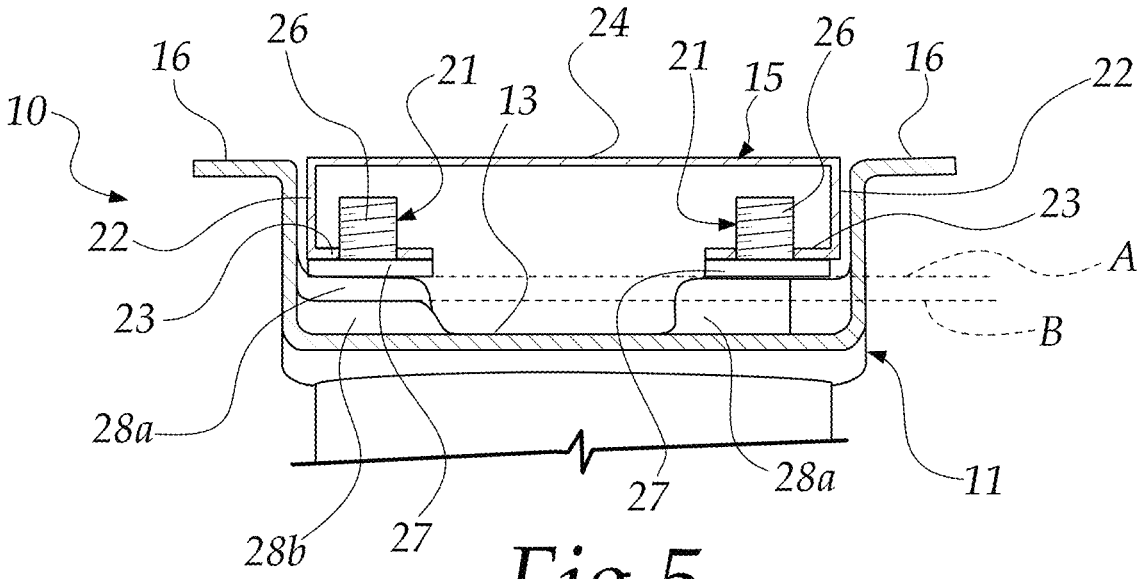
FIG. 5 is a transverse cross-sectional view of the drain assembly in the mode of use shown in FIG. 4*b;*
Figures 12, 13:
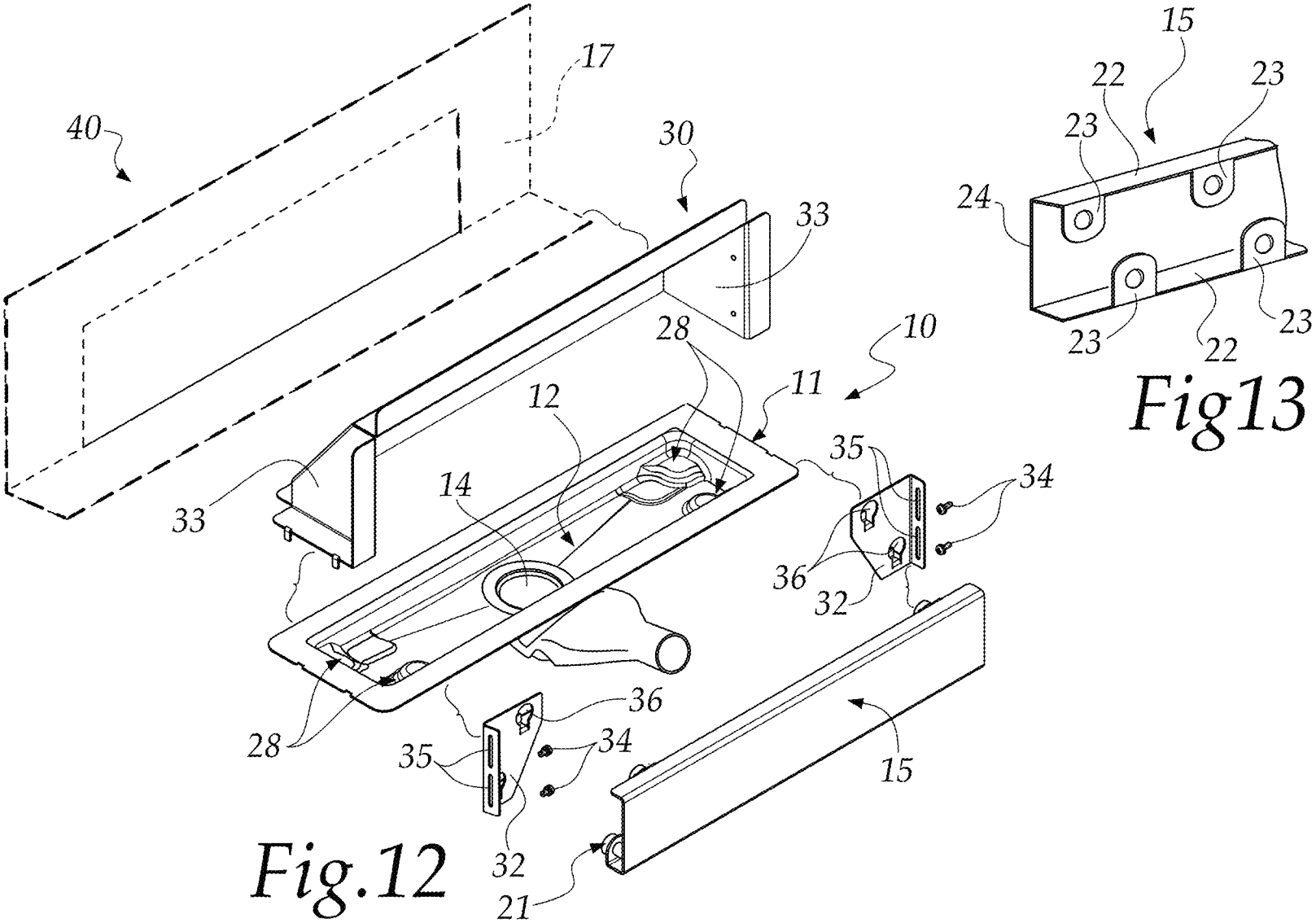
FIG. 12 is an exploded perspective view of a drain assembly according to the disclosure, as in FIGS. 10 and 11.
FIG. 13 is a view from the rear (with respect to its installation position) of a portion of the covering element.

The covering element 15 is constituted by a flat element made of metallic material, obtained by blanking and bending mutually opposing edges 22, as shown in FIG. 5. Perforated plates 23 protrude from the edges 22 and are folded on a plane parallel to the plane of arrangement of the main body 24 of the covering element 15. FIG. 13 shows a portion of the covering element 15 seen from the rear, i.e. from the rear part which during use is not visible.

In particular, such elements 21 that protrude from the covering element 15 are substantially mushroom-shaped, each one with a threaded shank 26 with which they are screwed to the covering element 15, into the holes of the plates 23, and a head 27. The elements 21 are made preferably of nylon. There can be multiple sets of elements 21 which have different lengths of the shank 26.

The tray element 12 of the trough 11 on the other hand is preferably made of molded steel and the dimensions can vary as a function of requirements, typically from 30 cm to 100 cm in length and it can have a longitudinal extension, with a typical width of approximately 5.5 cm, or a square shape, with sides preferably measuring 10 cm. The trough 11 therefore has a substantially rectangular shape and the bottom 13 has slopes that converge from the pairs of mutually opposite sides toward the drain hole 14, which is central, thus defining a double inward slope for the bottom 13.

The means 20 for association comprise, for the trough 11, studs 28 along two mutually opposite sides 29*a* and 29*b* of its perimeter, which protrude from the bottom 13 and are designed for the resting of the elements 21 of the covering element 15. In this case, the elements 21 act as feet for the covering element 15 to rest on the trough 11.

In particular, as can clearly be seen in the accompanying figures, the studs 28 have two portions of two different heights, of which a first portion 28*a* comes up to a first imaginary horizontal plane A and a second portion 28*b* comes up to a second imaginary horizontal plane B.

The studs 28 are distributed, with their first portions 28*a* and second portions 28*b*, along the two mutually opposite sides 29*a* and 29*b* and mirror-symmetrically with respect to a central plane that is transverse to the mutually opposite sides 29*a* and 29*b*.

Figure 3:
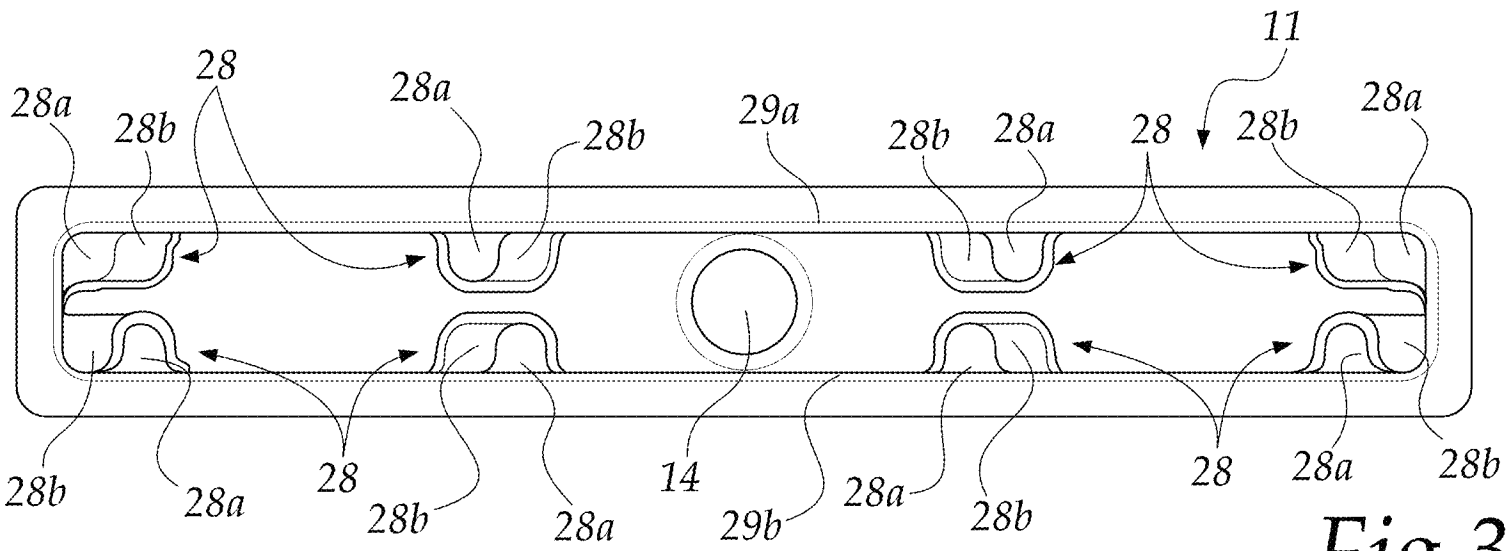
FIG. 3 is a plan view from above of the trough.

Preferably, there are studs 28 at the corners of the trough 11. FIG. 3 clearly shows the studs 28 with their portions, where it can be seen how they are distributed mirror-symmetrically with respect to the transverse central plane. Therefore, with respect to the illustration, a stud 28 at the far left, with the first portion 28*a* in the corner followed by the second portion 28*b* in the direction of the central plane, corresponds mirror-symmetrically to a stud 28 at the far right with the first portion 28*a* in the corner followed by the second portion 28*b* in the direction opposite to the previous one, i.e. again toward the central plane.

Furthermore, it can also be seen that the first portions 28*a* and the second portions 28*b* are present at one of the mutually opposite sides 29*a*, 29*b* in a position which is opposite respectively to the second portions 28*b* and to the first portions 28*a* which are present at the other one of the mutually opposite sides 29*a*, 29*b*.

The elements 21 are coupled to the covering element 15 in such a position as to rest, in the closed configuration of the trough 11, selectively on the first portions 28*a* or on the second portions 28*b*.

Substantially, the position of the plates 23 is defined by taking the position of the first portions 28*a* or of the second portions 28*b* as a reference, so that there is a correspondence between the covering element and the trough element.

Figure 4A:
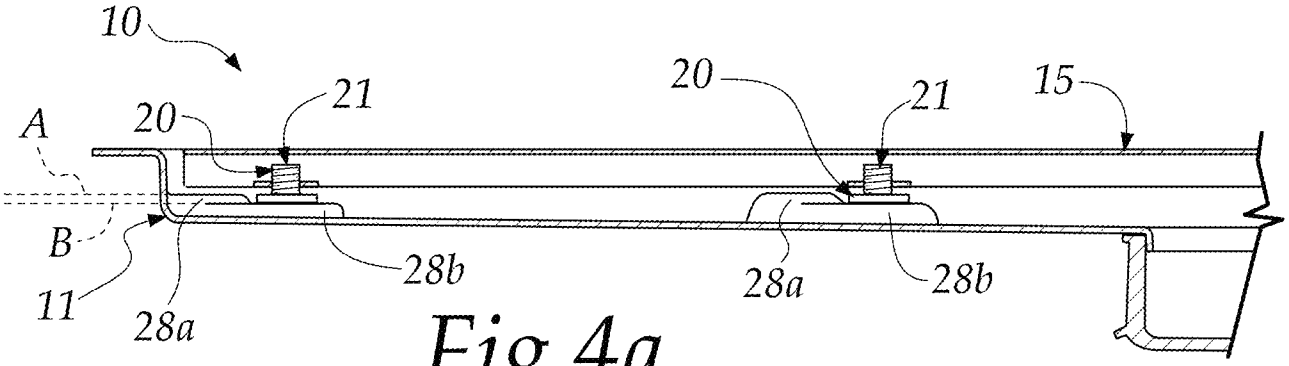
FIG. 4*a* is a longitudinal cross-sectional view of the drain assembly according to the disclosure, in a mode of use.
Figure 4B:
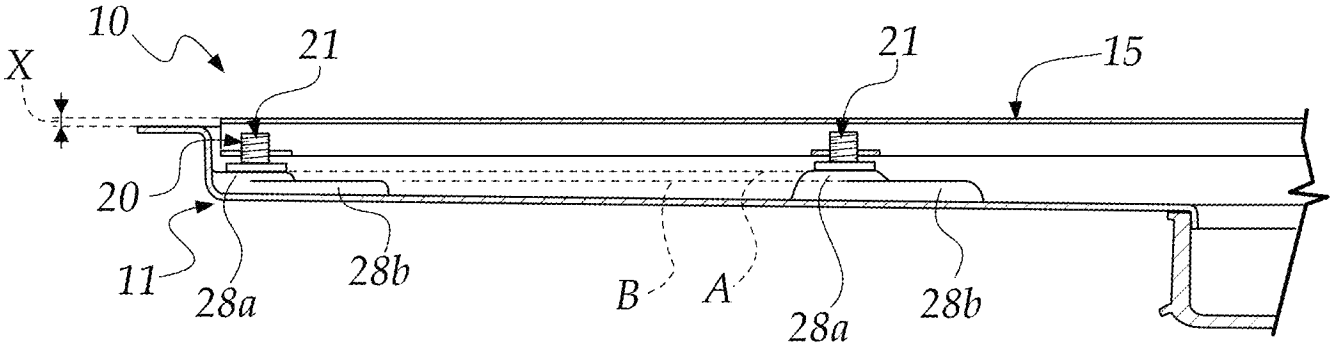
FIG. 4*b* is a cross-sectional view of the drain assembly according to the disclosure, as in FIG. 4*a*, in another mode of use.

FIG. 4*a* and FIG. 4*b* show two longitudinal cross-sections of the trough 11. The two figures show two different ways of using the same covering element 15. In particular, in FIG. 4*a* the covering element 15 is positioned on the trough 11 with elements 21 resting on the second portions 28*b*, while in FIG. 4*b* it is positioned with elements 21 resting on the first portions 28*a*.

Preferably, the resting seats, i.e. the first portions 28*a* and second portions 28*b*, define planes that are 6 mm apart.

In the first case, the covering element 15 is positioned flush with the trough 11, while in the second case, since the elements 21 rest on portions that are higher than the first, the covering element 15 is higher than the perimetric rim 16 by a quantity X, allowing tiles of greater thickness to be laid.

The height of the shank 26 of the elements 21 can be of different heights, according to requirements. For example, with a plane A at a height 1 mm above the drain hole 14 and a plane B at 7 mm from the drain hole, and using elements 21 with a shank of 14 mm, it is possible to position the covering element 15 flush with the trough 11 by resting it on the second portions 28*b*. Differently, using elements 21 with a shank 26 of 24 mm it is possible to position the covering element 15 above the trough 11 by resting it on the first portions 28*a*. Even using the same elements 21, positionings of the covering element 15 at different heights are obviously obtained. It is in fact sufficient to rotate the element through 180° so that the elements 21 will rest on the first portions 28*a* instead of on the second portions 28*b* and vice versa.

The same drain assembly 10 can therefore allow the installation of the covering element 15 at different heights, simply by rotating it through 180°.

Figure 7:
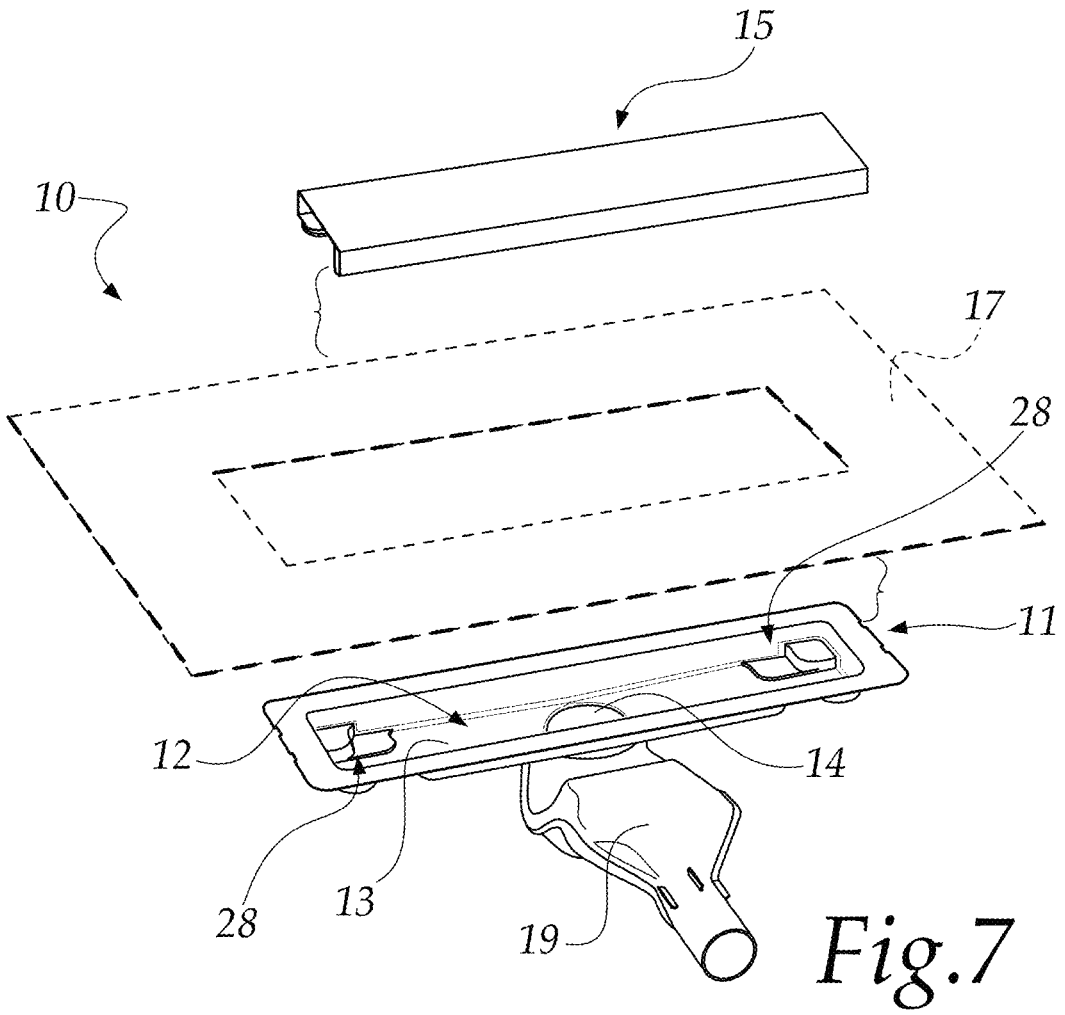
FIG. 7 is an exploded perspective view of another drain assembly according to the disclosure.
Figure 8:
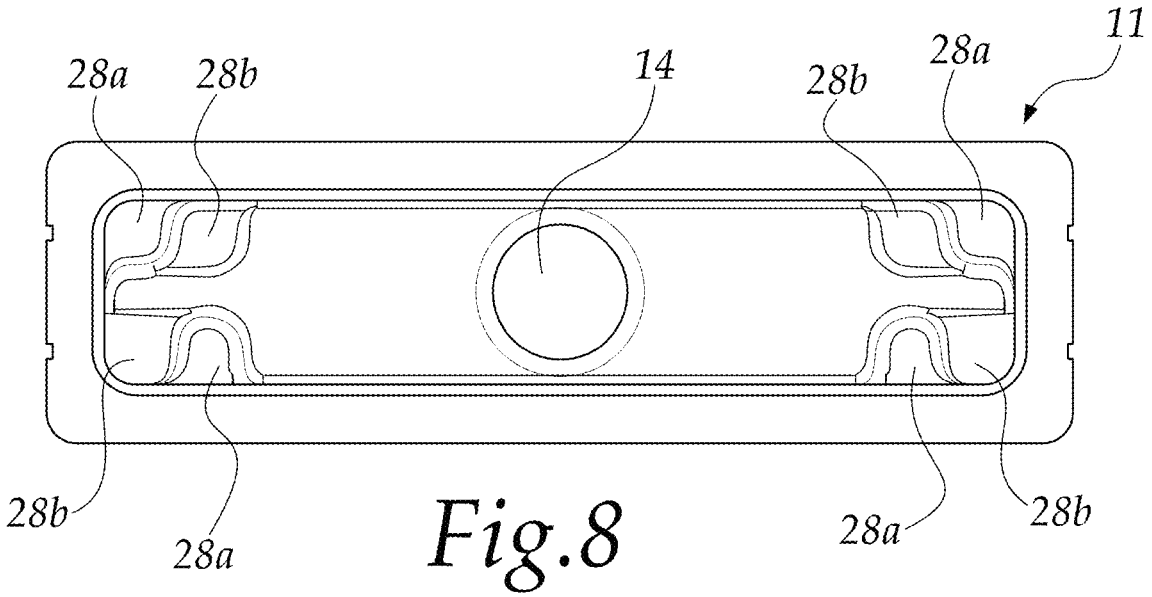

FIG. 7 shows a drain assembly 10 to be installed in a floor, of smaller dimensions than the previous drain assembly. FIG. 8 shows the trough 11 of the same drain assembly 10 in a plan view from above, from which the distribution of the studs 28 as described above can be seen. Owing to the limited dimensions, with respect to the trough shown in FIG. 1 and in FIG. 3, the studs 28 in this case are present only at the corners.

FIGS. 9*a*, 9*b*, 9*c* and 9*d* show drain assemblies 10 with covering elements 15 installed at different heights.

Figure 9A:
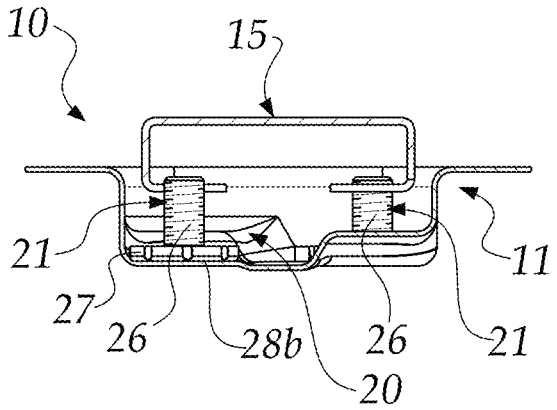
FIGS. 9*a*, 9*b*, 9*c* and 9*d* are transverse cross-sectional views of the drain assembly of FIG. 7, with the covering element installed at different heights.
Figure 9B:
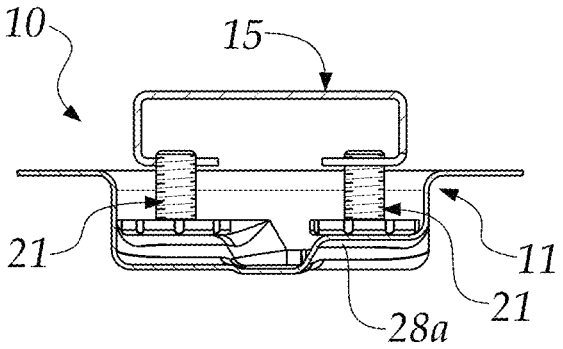
Figure 9C:
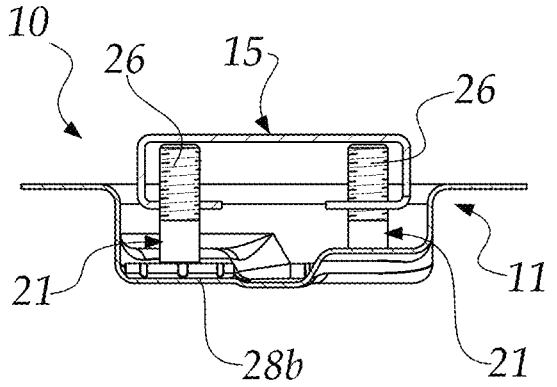
Figure 9D:
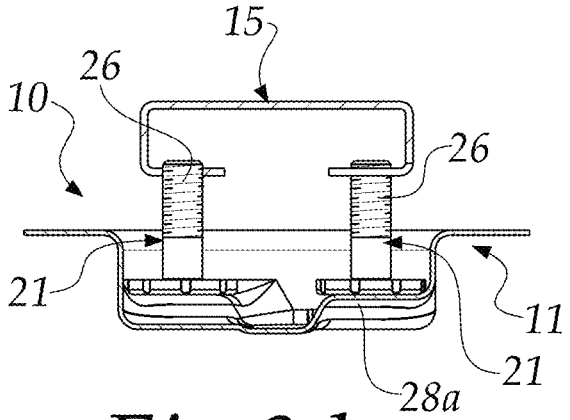

In FIG. 9*a* and FIG. 9*b*, elements 21 have been used with shanks 26 of the same length but resting respectively on the second portions 28*b* and on the first portions 28*a*. It is possible to obtain a double setting, by inverting the position of the covering element through 180° and screwing the shanks 26 into the respective plates 23. For example, it is possible to adjust the height from a minimum, flush with the perimetric rim 16, by completely or almost completely screwing the elements 21 into the covering element 15, to the maximum permitted, by screwing the elements 21 to the minimum required in order to ensure stability of the system. The minimum height can be obtained by screwing the elements 21 as far as possible and resting the covering element 15 on the second portions 28*b*, while the maximum height can be obtained by screwing the elements 21 as little as possible and resting the covering element 15 on the first portions 28*a*. Further adjustment can be obtained by choosing longer shank elements 26, as shown in the examples in FIGS. 9*c* and 9*d*, which show installations at the maximum and minimum heights obtainable with elements 21 provided with shanks 26 of equal length.

Figure 10:
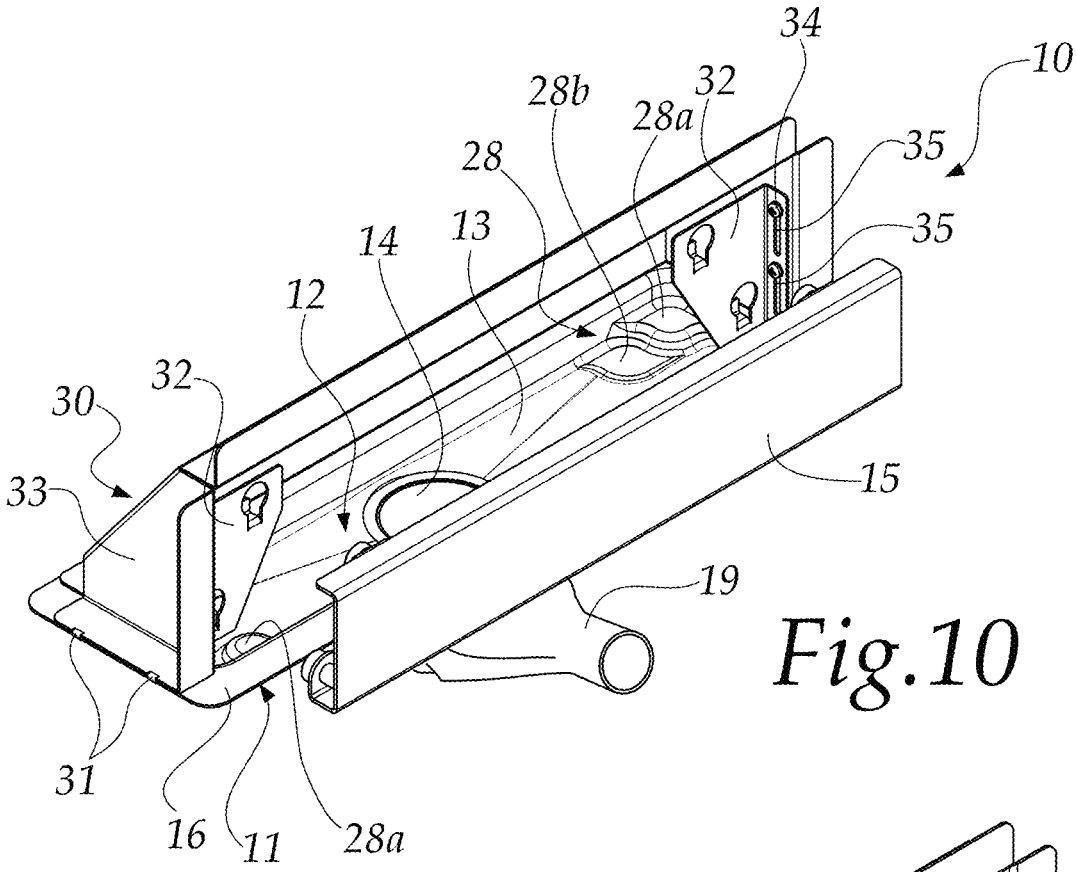
FIG. 10 is a perspective view of a drain assembly according to the disclosure, for installation in a wall, during application of the covering element.
Figure 11:
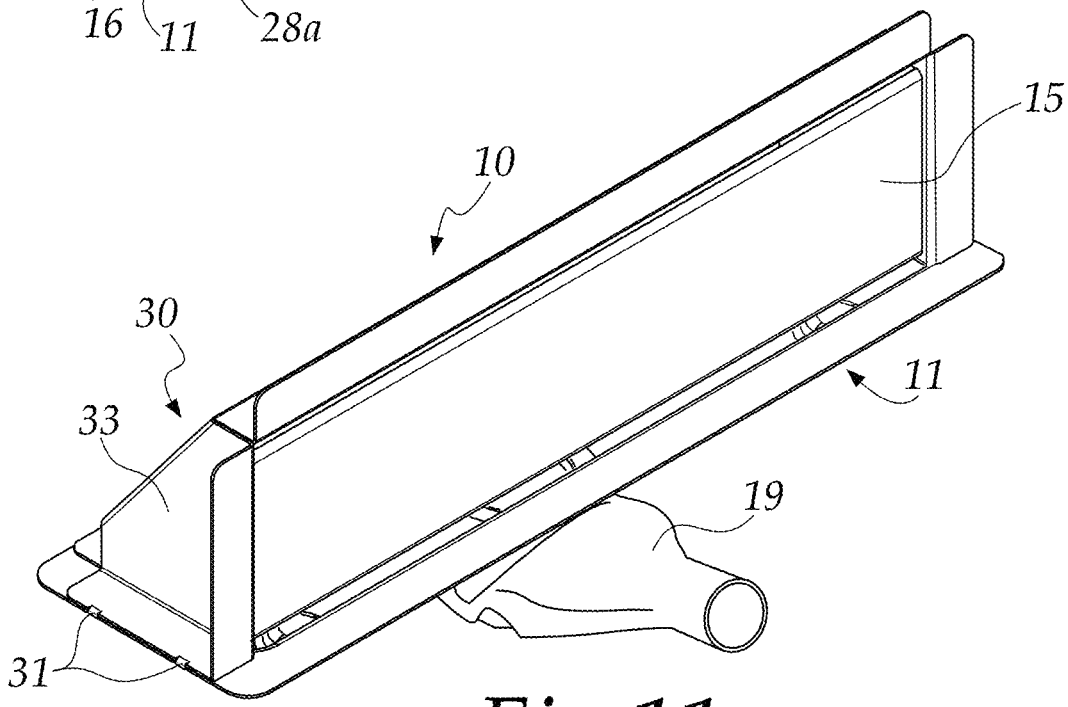
FIG. 11 is a view of the drain assembly according to the disclosure, as in FIG. 10, with the covering element applied.

The drain assembly 10 can be applied not only to floors but also to wall coverings, as shown in FIGS. 10-12. In particular, in such case the structure of the trough 11 comprises a roof-like element 30 which defines a cover on three sides for the tray element 12 and a cavity with a front opening, substantially vertical with respect to the installation position of the trough 11. Substantially the roof-like element 30 defines a recess to be set into a wall. The roof-like element 30 is fixed to the perimetric rim 16 of the trough 11 with the interposition of a moisture-curing sealant and using clips 31 which are to be bent below the perimetric rim 16.

The means 20 for association comprise a pair of vertical brackets 32 which partially occupy the front opening, and which are fixed to respective mutually opposite flanks 33 of the roof-like element 30 using screws 34 which pass through them at adapted slots 35. The vertical brackets 32 furthermore have holes 36, each one with an upper portion for inserting the heads 27 of the elements 21 and a lower portion of smaller dimensions which is adapted to prevent the accidental egress of those elements 21.

The covering element 15 can therefore be easily connected to the structure of the trough 11 simply by inserting the heads 27 of the elements 21 into the holes 36 and sliding downward, so as to bring the shanks 26 into the lower part of the holes 36. The covering element 15 is in this manner fixed to a wall. In this case too it is possible to use a template 18, like the one shown in FIG. 1 and in FIG. 6, and a waterproofing membrane, like the membrane 17 shown in FIG. 1, in this case folded by 90° at the joining line between the floor and the vertical wall of the shower, as shown in FIG. 12.

There can also be a smooth bottom, devoid of studs. In such case the final height of the covering element is adjustable by using sets of elements 21 with different shank lengths.

This solution is preferable in some cases, for example when the trough is square in plan and of reduced dimensions, for example with sides of 10 cm.

The drain assembly 10 can be conveniently sold as an installation kit that comprises at least:

- a trough 11 with a drain hole 14,
- a covering element 15 for the trough 11,
- a waterproofing membrane 17,
- a template 18 that can be inserted in the opening of the trough 11 in order to lay tiles around it,
- at least one set of elements 21 to be coupled to the covering element 15 so as to protrude therefrom, by an amount that is a function of the set, on the side that is not visible with respect to its installation position.

The kit 40 can in fact comprise multiple sets of elements 21 with shanks 26 of different lengths for each set. For example, with reference to the cases described above, it can comprise one set with a shank length of 14 mm and one with a shank length of 24 mm.

The use of the drain assembly, according to the disclosure, is evident from the foregoing description and explanation and, in particular, it is evident that it can be adapted to tiles of different heights and for both floor drains and wall drains.

In practice it has been found that the disclosure fully achieves the intended aim and objects by providing a drain assembly that can be used in installations with different thicknesses of tiles in order to ensure a final height that is flush with the floor and that can also be installed both in shower drainage systems that are flush with the floor, with a horizontal covering, and in shower drainage systems that are wall-mounted, with a vertical covering and flush with the wall.

The disclosure thus conceived is susceptible of numerous modifications and variations, all of which are within the scope of the appended claims. Moreover, all the details may be substituted by other, technically equivalent elements.

In practice the materials employed, provided they are compatible with the specific use, and the contingent dimensions and shapes, may be any according to requirements and to the state of the art.

What is claimed is:

1. A shower drain assembly, which comprises:

a trough with a tray element with a bottom thereof provided with a drain hole, a covering element for said trough, said drain assembly comprising association means configured for association between a structure of said trough and said covering element which are adapted to define various possible distances of the covering element from said bottom, wherein said association means comprise at least one set of elements to be coupled to said covering element so as to protrude therefrom on a side that is not visible with respect to an installation position thereof, wherein said association means comprise, for said trough, studs along two mutually opposite sides of a perimeter of the trough, which protrude from said bottom and are designed for a resting of said set of elements of said covering element, wherein said studs have two portions with two different heights, of which a first portion comes up to a first imaginary horizontal plane and a second portion comes up to a second imaginary horizontal plane.

2. The drain assembly according to claim 1, wherein said set of elements that protrude from said covering element are substantially mushroom-shaped, each element having a threaded shank with which said set of elements are coupled to said covering element and a head.

3. The drain assembly according to claim 1, wherein said trough has a substantially rectangular plan shape and said bottom has slopes which converge from pairs of mutually opposite sides toward said drain hole.

4. The drain assembly according to claim 1, wherein said studs are distributed, with said first portions and second portions of said studs, along said two mutually opposite sides and mirror-symmetrically with respect to a central plane that is transverse to said mutually opposite sides.

5. The drain assembly according to claim 1, wherein said first portions and said second portions are present at one of said mutually opposite sides in a position which is opposite respectively to said second portions and to said first portions which are present at another one of said mutually opposite sides.

6. The drain assembly according to claim 4, wherein said set of elements are coupled to said covering element in such a position as to rest, in a closed configuration of said trough, selectively on said first portions or on said second portions.

7. A shower drain assembly, which comprises:

a trough with a tray element with a bottom thereof provided with a drain hole, a covering element for said trough, said drain assembly comprising association means configured for association between a structure of said trough and said covering element which are adapted to define various possible distances of the covering element from said bottom, wherein said association means comprise at least one set of elements to be coupled to said covering element so as to protrude therefrom on a side that is not visible with respect to an installation position thereof, wherein said set of elements that protrude from said covering element are substantially mushroom-shaped, each element having a threaded shank with which said set of elements are coupled to said covering element and a head, wherein said structure of said trough comprises a roof element which defines a cover on three sides for said tray element and a cavity with a front opening, which is substantially vertical with respect to the installation position of said trough; said association means comprise a pair of vertical brackets which partially occupy said front opening, are fixed to respective mutually opposite flanks of said roof element, and are provided with holes, each hole having an upper portion for insertion of the heads of said elements and a lower portion which has smaller dimensions and is adapted to prevent an accidental exit of said elements.

8. A kit for installing a shower drain assembly, said kit comprises:

a trough with a tray element with a bottom thereof provided with a drain hole, a covering element for said trough, said drain assembly comprising association means configured for association between a structure of said trough and said covering element which are adapted to define various possible distances of the covering element from said bottom, wherein said association means comprise at least one set of elements to be coupled to said covering element so as to protrude therefrom on a side that is not visible with respect to an installation position thereof, wherein said association means comprise, for said trough, studs along two mutually opposite sides of a perimeter of the trough, which protrude from said bottom and are designed for a resting of said set of elements of said covering element, wherein said studs have two portions with two different heights, of which a first portion comes up to a first imaginary horizontal plane and a second portion comes up to a second imaginary horizontal plane a waterproofing membrane, a template configured to be inserted in an opening of said trough in order to lay tiles around said template, and at least one set of elements to be coupled to said covering element so as to protrude therefrom, by an amount that is a function of the set, on a side that is not visible with respect to an installation position.

* * * * *